United States Patent [19]

Schulman

[11] 4,260,456

[45] Apr. 7, 1981

[54] SINGLE RETORT MANUFACTURING TECHNIQUE FOR PRODUCING VALUABLE CHAR AND GASES FROM COKE

[75] Inventor: Bernard L. Schulman, Golden, Colo.

[73] Assignee: Tosco Corporation, Los Angeles, Calif.

[21] Appl. No.: 43,023

[22] Filed: May 29, 1979

[51] Int. Cl.[3] ..... C10B 49/16

[52] U.S. Cl. ..... 201/12; 48/210; 201/17; 201/31; 201/33; 201/36; 202/85; 202/121; 202/131

[58] Field of Search ..... 201/12, 17, 31, 33, 201/36, 37, 38, 10; 202/85, 91, 99, 100, 117, 121, 131, 136, 218, 221; 48/197 R, 202, 210; 208/8 R

[56] References Cited

U.S. PATENT DOCUMENTS

| | | | |
|---|---|---|---|
| 1,712,082 | 5/1929 | Koppers | 201/12 |
| 1,980,828 | 11/1934 | Reed et al. | 201/3 |
| 2,445,327 | 7/1948 | Keith | 201/31 X |
| 2,634,198 | 4/1953 | Kalbach | 48/197 R |
| 2,711,387 | 6/1955 | Matheson et al. | 201/38 X |
| 2,794,724 | 6/1957 | Mayland | 201/12 X |
| 3,140,241 | 7/1964 | Work et al. . | |
| 3,692,505 | 9/1972 | Reichl | 201/38 X |
| 3,761,233 | 9/1973 | Wenzel et al. | 48/202 |
| 3,990,865 | 11/1976 | Cybriwsky | 48/197 R |
| 4,158,620 | 6/1979 | Beck | 201/12 |

*Primary Examiner*—Frank W. Lutter

*Assistant Examiner*—Roger F. Phillips

*Attorney, Agent, or Firm*—Poms, Smith, Lande & Rose

[57] ABSTRACT

A single retort and accumulator structure includes two heating zones for successively removing volatile material from dried crushed coal so that the resultant calcined char has less than about 7 weight percent volatile material and is suitable as a raw material for producing formcoke. In the first zone (carbonizing zone) heat carrying solids are introduced with crushed coal to heat the powdered coal to a temperature in the order of about 800° F. to 1000° F. and produce a carbonized char containing about 10% to 20% by weight of volatile material. The resultant carbonized char is fed onto a trommel, or rotating cylindrical or tapered screen, and the char passes through the screen into a calcining fluidized bed zone. The fluidized bed is maintained by upwardly directed jets of an oxygen containing gas and steam. The temperature of the fluidized bed zone is in the vicinity of about 1200° F. to 1600° F. whereby the volatile material content of the particulate char is reduced to about 7 weight percent or less, as it is withdrawn from the fluidized bed. The heat carrying solids which supply heat to the first zone roll over the trommel, and are thereby separated from the powdered carbonized char, so that they may be reheated and used again. The volatile materials generated in the two heating zones are mixed and drawn off through a single outlet.

9 Claims, 2 Drawing Figures

SINGLE RETORT MANUFACTURING TECHNIQUE FOR PRODUCING VALUABLE CHAR AND GASES FROM COKE

FIELD OF THE INVENTION

This invention relates to techniques for making char having a low content of volatile material suitable for use in making formcoke.

BACKGROUND OF THE INVENTION

For centuries high grade coke has been produced in so-called coke ovens by the carbonization of coal (including peat). A large percentage of such coke is used in producing iron, e.g. in blast furnaces to reduce iron ore (iron oxide) to iron. In addition, coke is also used to reduce other metal ores such as copper, etc.. However, the production of coke, in coke ovens, is a very expensive process and requires, in general, a particular type of coal which oftentimes is not located in an area near where the users of the coke made from such coal are located.

Because of these and other deficiencies in the coke oven process, it is not surprising that prior art workers have attempted to develop more efficient processes for producing coke as well as processes which can utilize Western coal which is generally considered to be non-caking (non-agglomerating) coal. In this regard, it is noted although there are many different types or ranks of coal there are generally two broad types, at least in the United States. As noted, one is so-called Western coal which is generally considered to be non-caking and the other is Eastern coal, generally considered to be a caking coal. The coke oven process has used, for the most part, the Eastern or caking coal.

Among prior art processes which have attempted to produce coke using Western type coal is that disclosed in U.S. Pat. No. 3,140,241 (Work et al.). This patent discloses a six step process for producing coke from a non-caking type coal. Included within the process are two heating steps. The first heating step is referred to in the patent as the carbonizing stage. In the carbonizing stage dried coal is heated, in a fluid bed, in the presence of oxygen at a temperature of between 800° F. to 1200° F. in order to remove a portion of the volatile combustible matter from the coal. Thereafter, the carbonized char is heated in a second heating step referred to in the patent as the calcining stage. In the calcining stage the carbonized char is heated to a temperature of between 1500° F. to 1800° F. in a fluidizing atmosphere which is free of reactive gases such as carbon dioxide and steam.

The Work et al. patent suffers from a serious disadvantage in that the gases produced in the carbonizing step and calcining step are low Btu gases (i.e. less than 150 Btu's per standard cubic foot (scf)). Such low Btu gases cannot be used to supply heat necessary to carry out the process and this is a serious, if not fatal, disadvantage.

However, up to the present time, two separate steps have been employed for, first reducing the volatile matter included in coal to produce carbonized char having 10% to 20% volatile matter and then in a separate process and a separate retorting chamber, raising the temperature to remove a portion of the remaining volatile material from the carbonized char. This two-step process required the separate handling of the exhaust gases which are produced. In addition, substantial amounts of steam are normally required to control and eliminate tar condensation from the volatile matter produced in the carbonizing step.

An important object of the present invention is to simplify the process and avoid duplication of the gas cooling, fractionation, and sulfur removal equipment, as well as reducing the need for steam formerly employed to control and eliminate tar condensation.

SUMMARY OF THE INVENTION

In accordance with the present invention, the two steps of partial removal of the volatile materials at a temperature in the 800° F. to 1000° F. range, and the subsequent removal of additional volatile material at a higher temperature are combined in a single structure in which both of the processes occur, with a lower temperature retorting zone followed by a higher temperature fluid bed processing zone in which the volatile material content of the char is reduced to below about 7 weight percent.

In accordance with one aspect of the invention, dry coal crushed to less then one-half inch is contacted with heat carrying solids in a rotating retort, the temperature of the solids being sufficient to raise the temperature of the coal to between about 800° F. to about 1000° F. The coal is maintained at this temperature for a sufficient period of time to volatilize substantially all of the tar in the coal which, in general, is accomplished when the carbonized char contains about 5 weight percent to 25 weight percent volatile matter.

The carbonized char and heat carrying solids (which are larger than the carbonized char) are then conveyed to a trommel or screen through which the carbonized char passes, into a calcining fluid bed processing zone. The holes in the trommel or screen are smaller than the heat carrying solids so that solids do not pass through the holes, thus allowing easy and efficient separation of the heat carrying solids from the carbonized char. The solids, after separation from the char, are conveyed by the screen or trommel to a recovery zone for reuse in the rotating retort.

The volatile material from the carbonizing and calcining zones are mixed and pass through a single outlet of the structure for recovery. Common cycloning and fractionation equipment are connected to this common outlet to process the volatile material obtained from both of the two processes.

The mixing of the two gases (i.e., the volatile material from the carbonizing zone and the calcining zone) raises or maintains the temperature of the gas from the carbonizing zone to at least about 950° F. which eliminates tar condensation and the need for the extra steam normally added to control the dew point of the oils in the system. The combining of the gas streams also eliminates duplication of gas cooling and sulphur removing equipment. A collateral advantage of this technique is the providing of good control in obtaining a sufficient supply of sulphur-free gas to fuel the apparatus for heating the metal balls which are recirculated and supplied to the input of the apparatus with the powdered coal, as mentioned above. In addition, the use of a single unitary structure means that heat input requirements are held to a low level, as heat losses are minimized.

Other objects, features, and advantages of the invention will become apparent from a consideration of the following detailed description and from the accompanying drawings.

DETAILED DESCRIPTION

Figure 1:
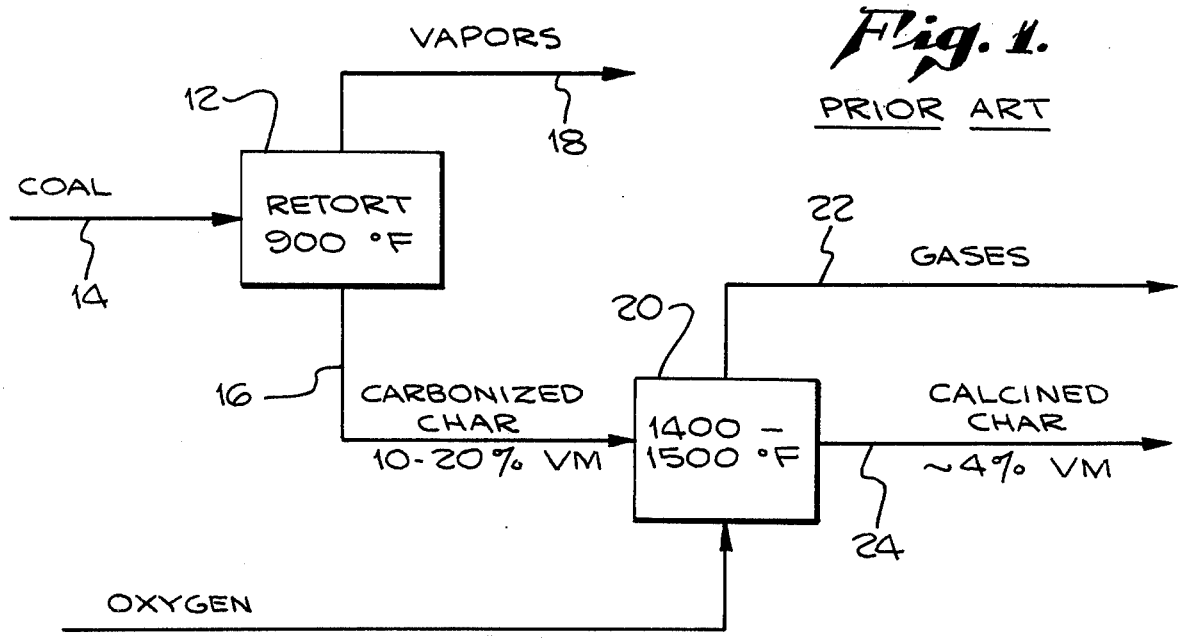
Fig. 1. PRIOR ART
FIG. 1 is a diagrammatic representation of the prior art two-step process for forming calcined char for use in form-coke.

With reference to the drawings, FIG. 1 shows a retort 12 to which coal is supplied as indicated diagrammatically by arrow 14. The carbonized char at 16 will have a content of volatile material of about 10 to 20 weight percent, with the retort temperature being in the order of 900° F. The vapors are shown being taken off at 18 for recovery or the like. The char is calcined in the fluidized bed apparatus 20, to which oxygen and steam is supplied, and from which the output gases are drawn off at 22, and the calcined char is shown diagrammatically being taken out at 24. The calcined char at 24 following calcination at a temperature of 1400° F. to 1500° F. will have a volatile material weight percentage content in the order of 4%.

Figure 2:
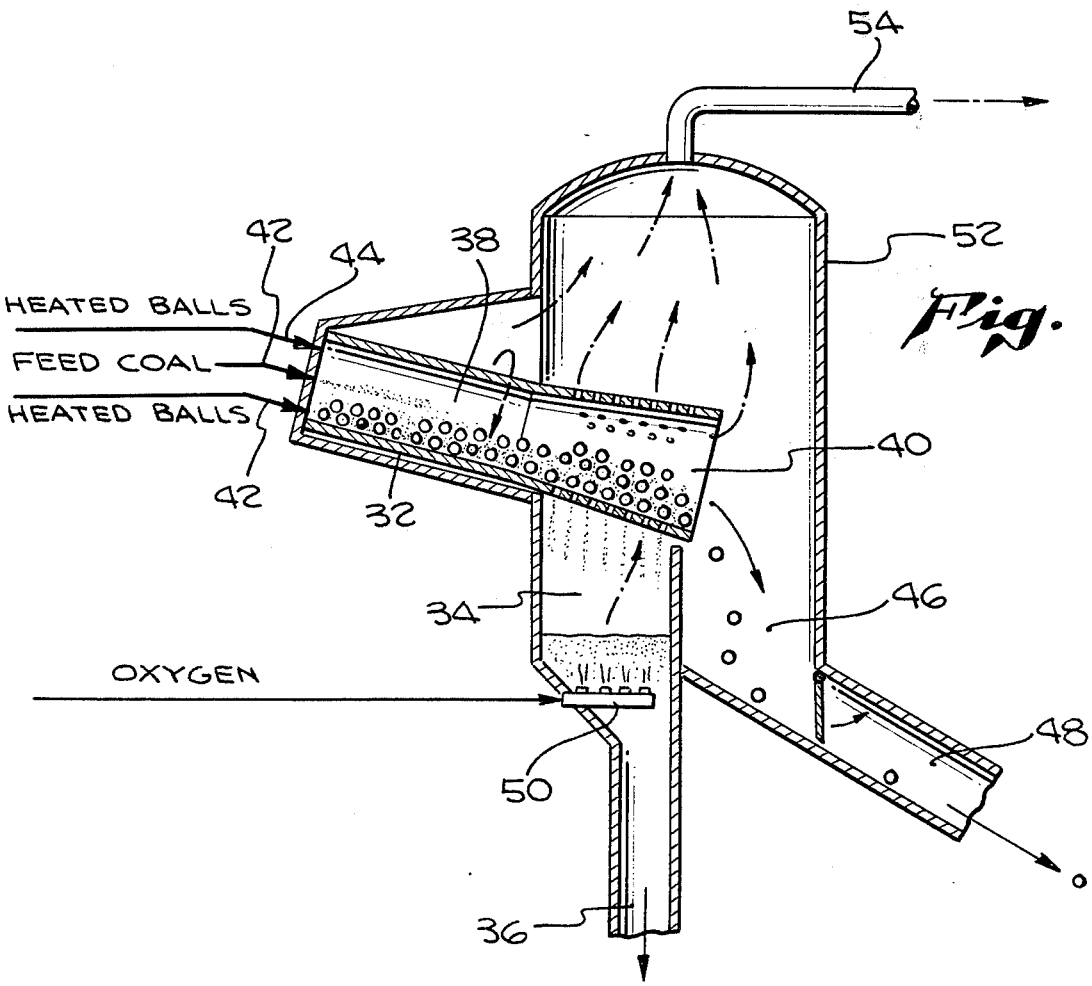
FIG. 2 is a schematic showing of a single retort apparatus by which the two-step process pictured in FIG. 1 is accomplished in an improved manner.

A process of the present invention using a single structure to accomplish both steps, is shown in FIG. 2. In FIG. 2 a relatively low temperature input zone 32 is provided which performs substantially the functions accomplished by the retort 12 of FIG. 1. The higher temperature zone 34 includes the fluid bed, and operates at a temperature in the order of 1200° F. to 1600° F. The resultant calcined char with its very low volatile material content is produced at output 36.

The input retorting section 32 may include a rotating retort including a solid section 38 and a screen section 40. Crushed feed coal and heat carrying solids which may suitably be in the form of inert balls (e.g., alumina balls), are supplied at the left-hand end of the retort 38 in the lower temperature zone 32, as indicated by the arrows 42 and 44. The hot inert balls which are supplied along with the powdered feed coal serve to heat the powdered coal to an elevated temperature to drive off the vapors and reduce the volatile material weight percentage content to between 5% and 25%, preferably between 10% and 20%. The apertures in the trommel or screen portion 40 of the rotating member 38, 40, are sufficiently small so that the inert balls which are supplied, pass out the open end of the trommel and are collected in the region 46 of the structure. They are then removed from the system through channel 48, heated, and elevated, and returned with the feed coal to the input of the retort section 32 of the structure.

The ball elevator and heater arrangements are not disclosed in the present application as they are well known and described in other patents assigned to the assignee of this invention, including U.S. Pat. No. 3,550,904, granted Dec. 29, 1970, for example.

The finely divided carbonized char from the carbonizing zone 32 drops through the small apertures in the trommel 40 into the fluidized bed zone 34 where additional volatile material in the form of gas is derived at the higher temperatures of the region 34. The fluidized bed is maintained by steam and an oxygen containing gas such as air or preferably pure oxygen, which are supplied to the jets 50 below the fluidized bed 34. Both the vapors from the carbonizing zone 32, and the gases from the calcining fluidizing bed zone 34, are mixed and drawn off from the structure 52 through the exhaust conduit 54 leading from the top of structure 52. As mentioned above, the presence of the hot gases from the fluidized bed zone 34 tends to prevent the condensation of the vapors in line 54 by elevating the hot gas temperature above the dew point. This elevation of the temperature above the dew point avoids the need for dew point control steam normally added to prevent such condensation, and also avoids the duplication of vapor and gas processing equipment which will be coupled to the line 54.

Many of the other details of the present process including operating parameters and the like correspond substantially to the process described in the co-pending patent application referenced hereinabove (Ser. No. 199,440), and accordingly, certain background material from that case is incorporated hereinbelow.

DESCRIPTION OF THE PREFERRED EXEMPLARY EMBODIMENT

The method of the present invention produces a high grade coke as well as gases having a high Btu content from any type of raw coal; more specifically, the output gas has at least 300 Btu's/scf and the devolatilized output char contains less than about 7 weight percent volatile combustible matter. The char produced in this process is an excellent source of coke by merely mixing the substantially completely devolatilized char with a binding agent therefor and forming an article of desired shape from said mixture and then curing and coking the shaped article.

Regardless of the type of coal utilized (i.e. Western or Eastern type coal) it is preferred in the present invention that before the coal is processed (i.e. heated to remove the volatile combustible matter) the coal be ground to form relatively small particles therefrom, e.g. the coal has a particle size of from minus ½ inch to minus ⅛ inch. After the coal has been ground, it is also preferred if the moisture from the coal is removed in a preheating step by, for example, heating the particularized coal at a temperature of from 200° F. to 600° F. and for a sufficient length of time until substantially all of the moisture is removed. If desired, and depending on the type of coal, the coal may be pretreated either before, after, or during the drying step, to de-cake the coal by contacting the coal with an oxidizing gas containing from 1% to 30%, by volume, of oxygen. This can be accomplished by, e.g. contacting the coal with a flue gas containing ½%–11%, by volume, oxygen having a temperature of up to about 1000° F., so that the coal is heated to a temperature of about 550° F. for approximately five to sixty minutes. Such a step will remove substantially all of the moisture from the coal. After the drying step most coals will contain anywhere from 20% to as high as 50%, by weight, of volatile combustible matter and from 75% to 50% fixed carbon.

After the coal has been dried and, optionally pretreated the substantially dried coal, which will contain less than about 5% by weight, of moisture, is transferred to a carbonizing zone 32 where a portion of the volatile combustible matter is removed from the coal, as described above.

In the carbonizing zone 32, in the absence of extraneous gases, the coal is heated to remove substantially all of the tar from the coal. In general, in the carbonizing zone the coal will be heated for a sufficient length of time to produce a carbonized char containing between about 20 weight percent and 10 weight percent volatile combustible matter and, preferably, depending on the coal, 16 to 17 weight percent volatile combustible matter. After the treatment in the carbonizing zone 32, the carbonized char will contain, in general, from 10 to 20 weight percent volatile combustible matter and from 80 percent fixed carbon with some minor amount of ash, etc. It is generally preferred that the temperature in the carbonizing zone 32 be between about 800° F. to as high as 1200° F. In the preferred exemplary embodiment the temperature which is used is between about 800° F. to 1000° F.

Heat can be supplied to the carbonizing zone in a number of ways. It is preferred that the heating be done in the absence of oxygen (i.e. by pyrolysis), as well as other non-extraneous gases. In the preferred exemplary embodiment the pyrolysis step is conducted by contacting the coal particles with heat carrying solids in a non-oxidizing atmosphere in a rotating retort 38, as shown in FIG. 2. The rotational speed of the retort is sufficient to mix the heat carrying solids with the coal particles in order to obtain good heat transfer between the coal particles and heat carrying solids. The specific rotational speed of the retort may vary greatly and is dependent upon the diameter of the retort. In the preferred exemplary embodiment, the retort 38 may have a diameter of about six feet and may rotate at a speed of between one revolution per minute (rpm) to 3 rpm). If a retort having a smaller diameter of about two feet were to be used, the preferred rotational speed would be between 4 rpm and 10 rpm.

During the pyrolysis step in the preferred exemplary embodiment the retort is sealed to prevent air or other extraneous gases from entering the retort and to insure that the heating (pyrolysis) is conducted in a non-oxidizing atmosphere.

The particular type of heat carrying solids utilized to heat the coal particles may vary widely and have any desired shape. For example, the heat carrying solid may be metal or ceramic and may have a ball-like shape of approximately ¼ inch to ½ inch diameter. In the preferred exemplary embodiment the heat carrying solids are alumina balls of approximately ½ inch diameter.

The residence time in the carbonizing zone 32 in the rotating retort 38 will also vary greatly depending upon the temperature and the amount of volatile combustible material in the raw coal. If a temperature of about 950° is used with a coal containing approximately 35% to 40%, by weight, of volatile combustible material, I have found that a 5 minute residence time is sufficient to produce a partially devolatilized char containing from 10 to 15 weight percent of volatile combustible material.

As mentioned above, the powdered char particles drop through the small apertures in the trommel 40 to the second heating zone 34 where it is treated in a fluidized bed. The apertures in the trommel 40 are much smaller than the size of the inert heating balls, so they pass over the second heating zone 34 and are collected in chamber 46 for reuse. In the fluidized bed 34 constituting the calcining zone the partially devolatilized char is heated to a temperature of, for example, 1200° F. to 1600° F. with the preferred embodiment range being from about 1300° F. to 1500° F. The fluidized bed parameters are adjusted in accordance with known principles to hold the carbonized particles for a sufficient length of time to produce a char containing less than about 7 weight percent of volatile combustible matter.

The air or oxygen and steam mixture applied to the bed may vary widely. Air may be used if the presence of nitrogen in the final product gas is not objectionable; however, the highest Btu gas is obtained using essentially pure, or more than 90% pure oxygen. In general, the amount of steam should be only that amount necessary to fluidize the bed, although this is not critical. The amount of oxygen contacting the carbonized char particles should be sufficient to raise the temperature to at least 1200° F. and, depending on the temperature of the steam, (which in general will vary from about 300° F. to as high as 1000° F.) the amount of oxygen will vary between about 0.03 and 0.08 pounds of oxygen per ton of carbonized char.

The amount of oxygen, relative to the amount of steam, in the gas mixture is not critical and may vary from 50% to 90% by volume, steam and from 10% to 50%, by volume, oxygen.

The substantially devolatilized calcined char exits from the second heating zone 34, is cooled and then mixed with a suitable binder. The mixture is formed into the desired shape (for example, the familiar briquette shape or pellets of a cylindrical shape) and cured and coked to produce excellent formcoke.

In the following preferred exemplary embodiment certain temperatures, gas compositions, etc. will be given; however, it is to be understood that the purpose of the preferred exemplary embodiments is to further explain the invention and are not to be considered limiting.

Illinois No. 6 coal containing approximately 8.48% water, 32.03% volatile combustible matter, 52.46% fixed carbon and 6.67% ash was fed to a preheater and heated to a temperature between about 500° F. to 600° F. with a gas having an oxygen content of 5%, by volume, and a temperature of 700° F. The raw coal was heated for a period of about 15 to 60 minutes. The dried coal contained approximately 35 weight percent volatile combustible matter, 58 weight percent fixed carbon, and 7 weight percent ash. The dried coal particles were fed to the rotating retort 38 and contacted with heat carrying solids having a temperature of about 1250° F. which raised the temperature of the coal to about 930° F. The retort was rotated at a sufficient speed to mix the heat-carrying solids with the coal particles (about 2 rpm). The residence time to reduce the volatile combustible matter to between 10 and 20 weight percent (in the preferred exemplary embodiment to about 14 weight percent) took about five minutes. The rotating retort was sealed from the atmosphere and therefore the gases evolved during the pyrolysis step contain no adulterating gases.

Thereafter, the carbonized char, which contained approximately 14 weight percent volatile combustible matter, was transferred by the trommel 40 to the calcining zone 34 where it was contacted with a gas mixture having a temperature of about 950° F. and containing 80%, by volume, of steam and 20%, by volume, of oxygen. The partially devolatilized char was heated to a temperature of about 1600° F. in the fluidized bed. The resultant char had about 4 weight percent volatile combustible matter with the remainder of the char being fixed carbon with a slight amount of ash (about 10%). This char was used to produce coke having excellent properties by mixing the char with about a 15 weight percent of a coal tar binder and forming pellets from the mixture at a pressure of about 300 psi. The pellets were cured at 450° F. and coked, in a non-oxidizing atmosphere at about 1500° F. The vapors and gases derived from the two heating steps were mixed and withdrawn together from the top of structure 52 at outlet 54. These gases were at a temperature in excess of 950° F. to prevent tar condensation and had a relatively high Btu content of about 600 to 700 Btu/scf.

In another preferred exemplary embodiment dry Illinois No. 6 coal (dried as indicated above) was pyrolyzed in the first heating zone as in the first exemplary embodiment. However, in the second heating zone the partially devolatilized char was heated to a temperature of about 1400° F. using a gas mixture of 70%, by volume, of steam and 30%, by volume, of oxygen at a pressure of about 17 psig and a temperature of about 950° F. The mixture of gases withdrawn at 54 had a temperature in excess of 950° F. and a Btu content of about 600 Btu/scf and the char contained less than about 5 weight percent volatile combustible matter.

The char produced in this exemplary embodiment was mixed with about 17%, by weight, of coal tar binder at a temperature of about 210° F. The mixture was formed into pellets ¾ inches in diameter and one inch long under a pressure of 300 psi. The pellets were then cured for two hours at 450° F. in an oxidizing atmosphere and then the cured pellets were then coked at 1500° F. for 30 minutes in a muffle furnace, using sand and char to cover the pellets to prevent oxidation. The cured and coked pellets had a crushing strength of approximately 1,850 psi.

In conclusion, the foregoing description of the method and apparatus is merely illustrative of the principles of the invention; other alternatives within the scope of one skilled in the art may be employed to accomplish the various disclosed steps. Thus, by way of example and not of limitation, a vibrating feed, partly solid and partly perforate could be substituted for the rotating feed arrangements 38, 40 described above. Accordingly, the present invention is to be construed only in accordance with the following claims.

What is claimed is:

1. A method for efficiently producing char and valuable gases from coal comprising the steps of:

supplying dry feed coal particles to a multizone retort structure, contacting said feed coal with heat carrying solids to heat said feed coal to a temperature of from about 800 degrees F. to 1200 degrees F. in a carbonizing zone within said structure for a sufficient period of time to produce valuable gases from said coal feed and to produce carbonized char particles having a volatile matter content of about 5% to 25% by weight;

separating said heat carrying solids from said char particles;

feeding said carbonized char particles to a calcining zone in said retort structure;

forming a fluidized bed in said calcining zone by contacting said carbonized char particles with steam and an oxygen containing gas to heat said carbonized char to a temperature of about 1200 degrees F. to 1600 degrees F. for a sufficient length of time to produce valuable gases from said carbonized char particles and to produce a calcined char having a volatile matter content of less than about 7% by weight;

mixing said gases from said carbonizing zone and said calcining zone at a temperature in excess of about 950 degrees F. to prevent condensation of tars from said gas produced in said carbonizing zone;

drawing off said mixture of gases from said retort structure; and collecting substantially all of said calcined char from said fluidized bed calcining zone and directing said calcined char out of said retort structure;

whereby said feed coal particles are all subjected to substantially the same lower temperature carbonizing and higher temperature calcining steps to produce a relatively uniform char with low volatile matter content.

2. A method for efficiently producing char and valuable gases from coal as defined in claim 1 wherein said separating step is accomplished by conveying said carbonized char and said heat carrying solids to a screen having a mesh size sufficient to allow said char particles to pass through the screen but insufficient to let said heat carrying solids pass through.

3. A method according to claim 1 wherein said oxygen containing gas is oxygen.

4. A method according to claim 3 wherein the amount of oxygen contacting said carbonized char in said fluid bed in between about 0.03 and 0.08 pounds of oxygen per pound of carbonized char.

5. A method according to claim 1 wherein the temperature of said coal particles in said carbonizing zone is between about 800° F. and 1000° F.

6. A method for efficiently producing char and valuable gases from coal comprising the steps of:

supplying dry feed coal particles to a multizone retort structure, contacting said feed coal with substantially inert heat-carrying solids in a rotating retort to heat said feed coal to a temperature of from about 800 degrees F. to 1200 degrees F. in a carbonizing zone within said structure for a sufficient period of time to produce valuable gases from said coal feed and to produce carbonized char particles having a volatile matter content of about 5% to 25% by weight;

separating said heat carrying solids from said char particles;

feeding said carbonized char particles to a calcining zone in said retort structure;

forming a fluidized bed in said calcining zone by contacting said carbonized char particles with an oxygen containing gas to heat said carbonized char to a temperature of about 1200 degrees F. to 1600 degrees F. for a sufficient length of time to produce valuable gases from said carbonized char particles and to produce a calcined char having a volatile matter content of less than about 7% by weight;

mixing said gases from said carbonizing zone and said calcining zone at a temperature in excess of about 950 degrees F. to prevent condensation of tars from said gas produced in said carbonizing zone;

drawing off said mixture of gases from said retort structure; and directing substantially all of said calcined char from said calcining zone out of said retort without return to said carbonizing zone.

7. A method as defined in claim 6 wherein said step of contacting said feed coal with inert heat carrying solids includes the step of supplying said heat carrying solids in the form of substantially inert balls and rotating said heat carrying balls and said coal particles together in said rotating retort.

8. A method as defined in claim 6 wherein said heat carrying solids are of greater size than said coal particles, and wherein said separating step includes supplying said heat carrying solids and said coal particles to a moving screen having openings smaller than the size of said heat carrying solids and larger than said particles.

9. A method as defined in claim 8 wherein said separating step includes the rotation of a trommel at the output of the rotating retort.

* * * * *